United States Patent [19]

Lohr et al.

[11] Patent Number: 4,580,863

[45] Date of Patent: Apr. 8, 1986

[54] ELECTRICAL CONTACT SOCKET WHICH IS MANUFACTURED WITH SIMPLIFIED TOOLING

[75] Inventors: Claudia I. Lohr, Heppenheim; Werner Moritz, Kleinostheim, both of Fed. Rep. of Germany

[73] Assignee: AMP Incorporated, Harrisburg, Pa.

[21] Appl. No.: 702,710

[22] Filed: Feb. 19, 1985

[51] Int. Cl.[4] ..... H01R 4/00

[52] U.S. Cl. ..... 339/94 M; 339/196 M; 339/198 R; 339/242; 339/248 R

[58] Field of Search ..... 339/94, 198 R, 198 P, 339/198 S, 143 R, 143 P, 147, 256 R, 258 R, 258 A, 258 P, 258 RR, 242, 248

[56] References Cited

U.S. PATENT DOCUMENTS

| | | | |
|---|---|---|---|
| 2,205,878 | 6/1940 | Eby | 339/198 S |
| 3,152,849 | 10/1964 | Deakin | 339/18 C |
| 3,423,716 | 1/1969 | Deakin | 339/18 B |
| 3,426,319 | 2/1969 | Downs et al. | 339/242 |
| 3,881,795 | 5/1975 | Cobaugh et al. | 339/147 P |
| 4,015,889 | 4/1977 | Blanchet | 339/19 |
| 4,020,430 | 4/1977 | Vander Heyden | 339/143 R |
| 4,084,870 | 4/1978 | Laserson et al. | 339/147 P |
| 4,519,665 | 5/1985 | Althouse et al. | 339/143 R |

*Primary Examiner*—Gil Weidenfeld
*Assistant Examiner*—David L. Pirlot
*Attorney, Agent, or Firm*—Frederick W. Raring

[57] ABSTRACT

Electrical contact socket comprises a flat face having a circular opening therein adjacent to one edge of the face. Diametric slots extend from the opening parallel to the one edge and have blind ends. Contact flanges extend from the periphery of the opening perpendicularly of the plane of the face and serve as contact surfaces when a pin is inserted into the opening. The portion or section of the face between the opening and the one edge is resiliently deflected when the pin is inserted and serves as a contact spring.

7 Claims, 8 Drawing Figures

ELECTRICAL CONTACT SOCKET WHICH IS MANUFACTURED WITH SIMPLIFIED TOOLING

FIELD OF THE INVENTION

This invention relates to electrical contact sockets of the type which are intended to receive a cylindrical contact pin and which have a contact spring for maintaining a contact force on the inserted pin.

BACKGROUND OF THE INVENTION

Conventional stamped and formed sheet metal electrical contact sockets are manufactured by providing a rectangular blank having parallel side edges and forming the blank in a series of steps into a cylindrical shape until the side edges are substantially against each other. Thereafter, a contact spring may be provided to provide the contact force for an inserted pin and it is also common practice to mount a cylindrical ring on the socket to prevent the seam from opening up when the pin is inserted. This manufacturing process is relatively complex and requires expensive tooling, particularly in forming the flat blank into a cylindrical shape. Also, the contact spring and the cylindrical ring or retainer must be assembled to the socket in separate assembly operations. The present invention is directed to the achievement of an improved contact socket which can be manufactured with simplified tooling and which does not require the separate assembly steps of the method previously described.

The invention is further directed to the achievement of a cluster of contact sockets of the type which are used in terminal junction systems comprising a group of contact sockets which are electrically commoned and which serve to make common electrical connections among inserted contact pins.

THE INVENTION

In accordance with one embodiment, the invention comprises a stamped and formed contact socket which is dimensioned to receive a contact pin. The socket is of the type having a contact spring for maintaining contact force on an inserted contact pin. The contact socket of the invention is characterized in that the contact socket comprises an opening in a flat face, the face having side edges and at least one end edge which extends perpendicularly with respect to the side edges and which is adjacent to the opening. Each of the side edges has a side flange extending therefrom perpendicularly of the face. A pair of diametric slots extend from the opening to the side edges and into the side flanges. Contact flanges extend in the one direction from the periphery of the opening, the contact flanges having contact surfaces which are contacted upon insertion of the pin into the opening. The face has an end section which is between the opening and the one end edge whereby upon insertion of a contact pin into the opening, the contact flanges of the opening will be against the contact pin and the end section of the face and portions of the side flanges which are between the one end and the slots will be resiliently reflected and serve as the contact spring.

In accordance with a further embodiment, a cluster of at least two electrically common contact sockets are provided as described above, the cluster comprising a one piece section of conductive sheet metal having a rectangular face which has side edges and first and second end edges. The side edges have side flanges extending therefrom in one direction. The contact sockets comprise first and second openings in the face which are proximate to the first and second end edges respectively and between the side edges. Each of the openings has a pair of diametric slots extending therefrom to the side edges and into the flanges, the slots having blind ends which are in the flanges. The slots in the openings divide the cluster into first and second end sections and a center section, the center section being between the first and second openings in the slots, and the first and second end sections extending from the first and second openings and slots to the first and second end edges respectively. The face has contact flanges extending therefrom at the peripheries of the openings, the contact flanges being between the slots.

In accordance with a further embodiment, the invention comprises a method of manufacturing an electrical contact socket comprising the steps of providing a flat blank of conductive sheet metal having one end edge. An elongated slot is punched in the blank which slot extends parallel to the one end edge and has two parallel slot edges extending to its ends. The method further comprises the step of punching out a pair of spaced-apart openings adjacent to each of the slot edges with the openings opposed to each on opposite sides of the slot and between the blind ends of the blank. Thereafter, a circular opening is punched in the blank with a punch and die, the opening having its center midway between the spaced-apart openings and on the centerline of the slot. Simultaneously, the isolated material between the spaced-apart openings is formed in a direction perpendicular to the plane of the blank so that the isolated material forms cylindrical flanges extending perpendicularly from the periphery of the opening.

THE DRAWING FIGURES

THE DISCLOSED EMBODIMENT

Figure 1:
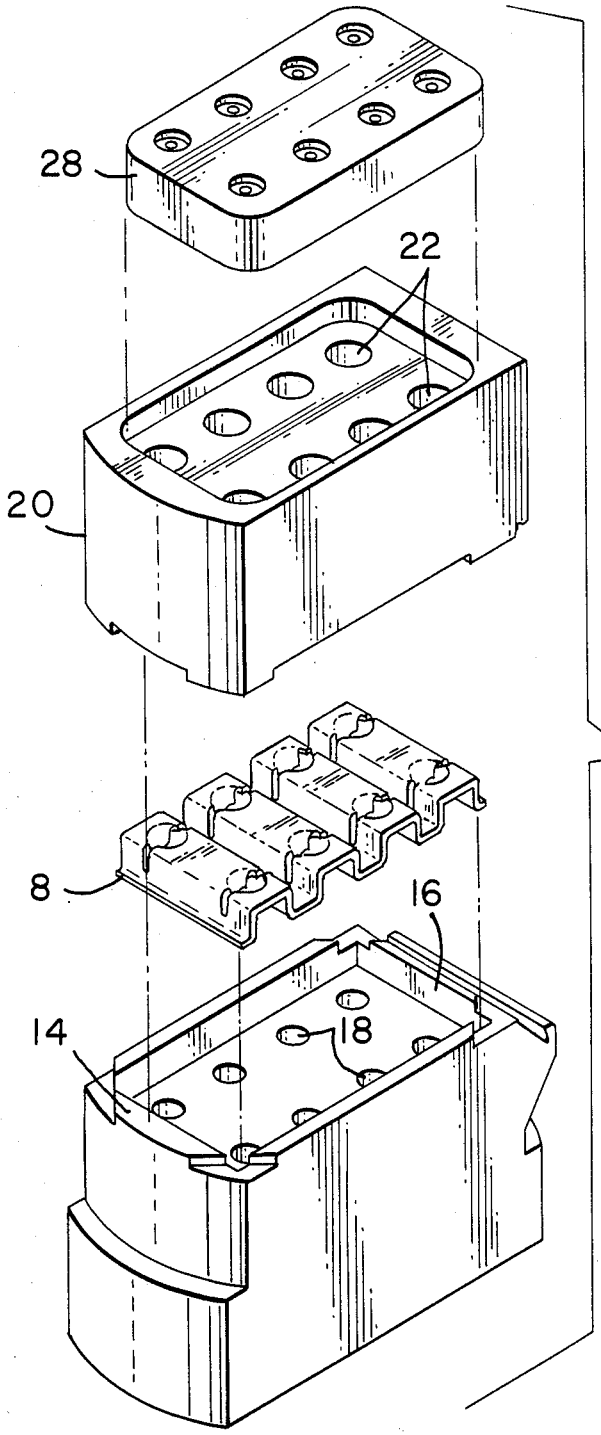
FIG. 1 is a perspective view with the parts exploded from each other of a conventional terminal junction module containing a cluster of electrical contact sockets in accordance with the invention.
Figure 2:
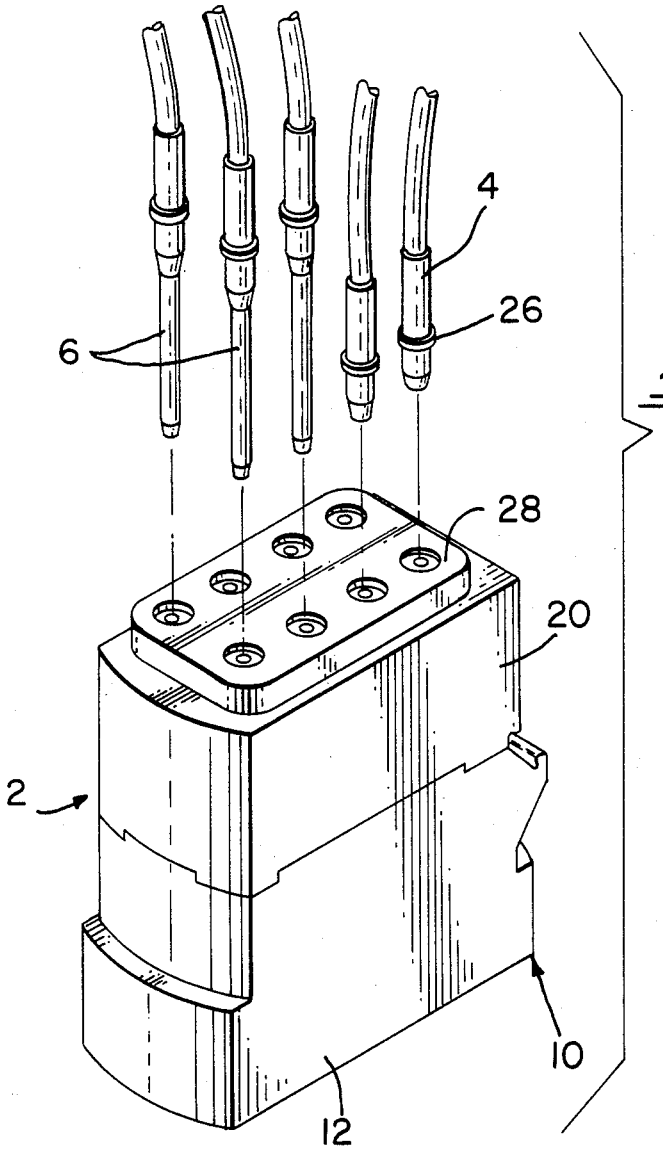
FIG. 2 is a perspective view of the module with the part assembled to each other.
Figure 3:
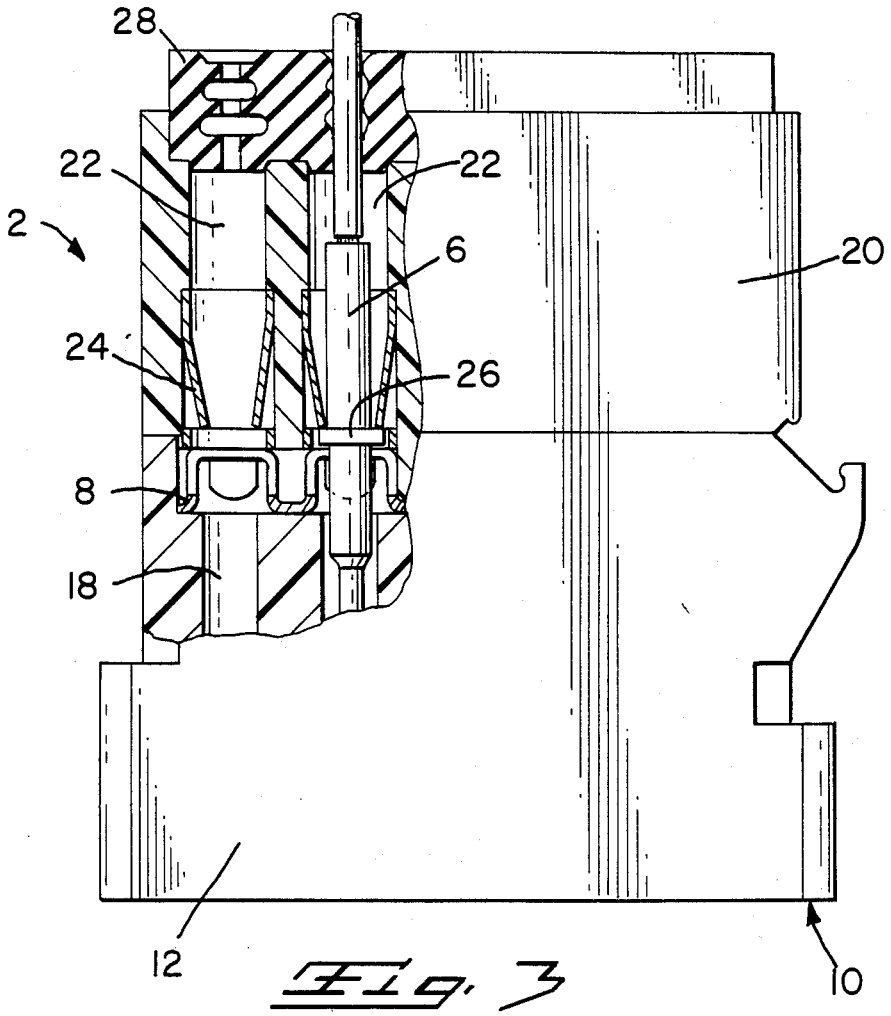
FIG. 3 is a side view of the module partly in section showing the positions of the cluster of sockets.

FIGS. 1 to 3 show a terminal junction module 2 of a type which is intended to receive either of the two types of contact pins shown at 4 or 6 in order to electrically connect the pins to each other. Modules of this type are provided with one or more clusters 8 of contact sockets so all of the pins inserted into the modulue and into a particular cluster will be commonly connected. The disclosed module 2 is adapted to accept up to eight contact pins and the module may contain one cluster 8 or it may contain more than one cluster having lower numbers of sockets. The present invention is concerned particularly with the contact sockets of the cluster 8. However, the structure of the modulue will be briefly described. The module comprises a housing assembly 10 having a body section 12 and a top section 20. A recess 16 extends into the uper end 14 of the body section and receives the cluster of sockets as will be described below. Cavities 18 extend from the recess into the main body section 12 and are of a length to receive either the relatively long type of pin shown at 6 or the short pin 4. The top section has cavities 22 which are in alignment with the cavities 18 and contains retaining members 24 which serve no electrical function but which have retaining lances that lodge behind collars 26 on the contacts. The contact pins can, however, be removed with a suitable tool. Finally, a sealing grommet 28 is conventionally provided on the upper end of the top section as shown.

Figure 4:
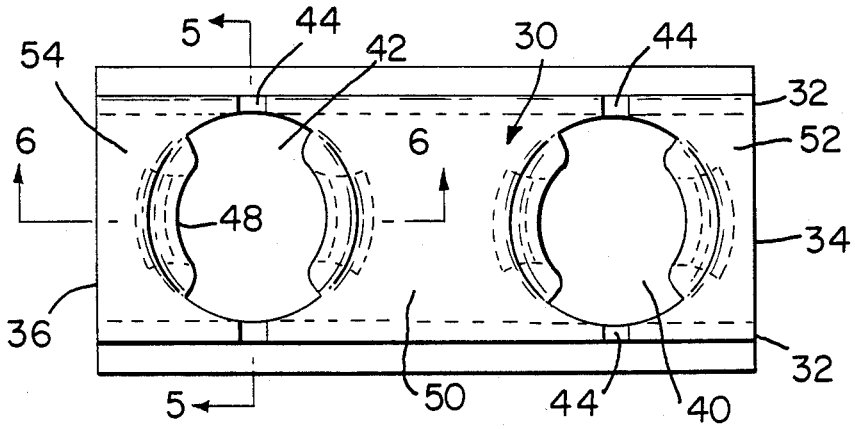
FIG. 4 is a plan view of a cluster of contact sockets in accordance with the invention containing two sockets.
Figure 5:
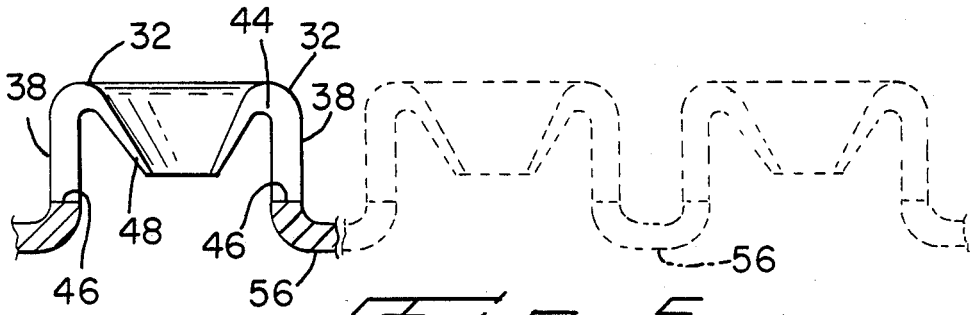
FIG. 5 is a view looking in the direction of the arrows 5—5 of FIG. 4 and showing in phantom two additional rows of sockets.
Figure 6:
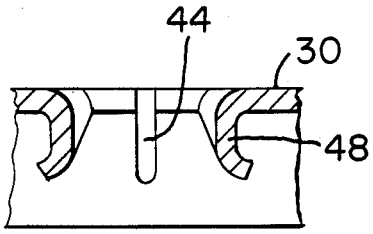
FIG. 6 is a view looking in the direction of the arrows 6—6 and 7 of FIG. 4.

FIGS. 4 to 6 show a cluster of two contact sockets in accordance with the invention. The cluster is manufactured from suitable conductive sheet metal and has a flat rectangular face 30 having parallel side edges 32 and having first and second end edges 34, 36. Side flanges 38 extend from the side edges normally or perpendicularly of the plane of the face.

The sockets comprise first and second openings 40, 42 which are adjacent to the first and second end edges 34, 36. Each opening has a pair of diametric slots 44 which extend from the opening to the side edges 32 and into the side flanges. These slots have blind ends 46 which are in the flanges. In addition, contact flanges 48 extend from opposite sides of each opening and between the slots 44.

The openings and the slots divide the cluster into first and second end sections 52, 54 and a center section 50. The end sections extend from the openings and the slots 44 to the end edges 34, 36 while the center section 50 is between the openings.

The openings 40, 42 are dimensioned to receive the contact portions of either of the types of contact pins shown at 4 and 6 with an interference fit with the contact surfaces of the pins. When a pin is inserted into one of the openings, the contact surface of the pin will be against the surfaces of the contact flanges 48. The first and second end sections 52, 54 serve as contact springs in that these sections can be deflected when the pin is inserted by virtue of the provision of the slots 44. The center section 50 is placed in compression when pins are inserted into the openings and does not deflect to any significant extent.

As will be explained below, contact sockets in accordance with the invention are manufactured in a progressive die by stamping and forming and a cluster of any number desired can be provided. In the terminal junction system shown, the maximum number of sockets in a cluster is eight although a module may contain several smaller clusters as explained above.

Figure 7:
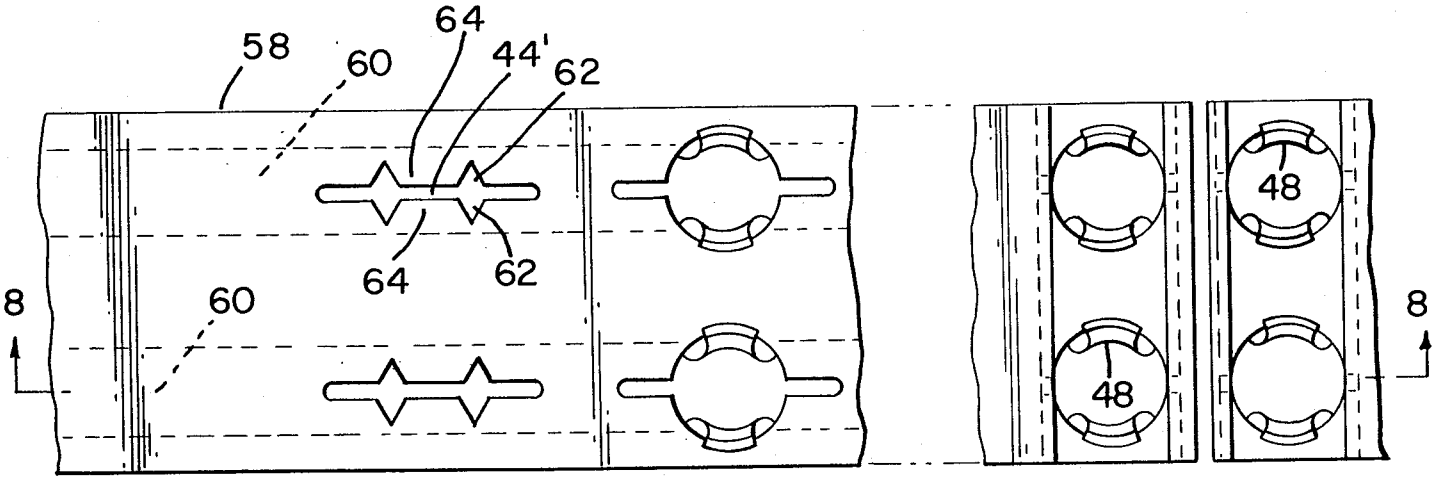
FIG. 7 is a plan view of a strip of conductive sheet metal showing the several steps in the manufacture of contact socket clusters as shown in FIGS. 1 to 6.
Figure 8:
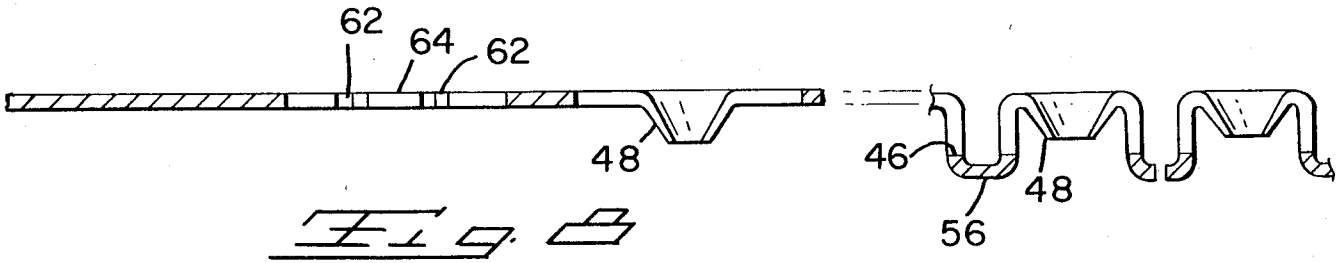
FIG. 8 is a view looking in the direction of the arrows 8—8 of FIG. 7.

FIGS. 7 and 8 show the several steps involved in the manufacture of contact sockets in accordance with the invention. The sockets are manufactured from a continuous strip 58 of conductive sheet metal which may be plated as shown at 60 to provide conductive metal plating on the contact flanges of the finished sockets. In the first stage of the manufacture, elongated slots 44' are punched in the metal and openings 62 are provided between the blind end of the slots and extending outwardly from the side edges of the slots. The formation of the opening 62 has the effect of isolating sections 64 of metal which later become the contact flanges. After formation of the slots 44' and the opening 62, the circular openings are produced with simple punch and die tooling, that is a substantially cylindrical punch which is dimenionsed to be received in a die having a cylindrical opening. When these openings are formed, depending upon the design of the tooling, there may be some drawing of metal but in all events, the flanges are formed by bending the material 64 downwardly into the opening. After the openings have been formed, it is merely necessary to again bend the strip to produce the side edges 32 of the individual clusters and adjacent clusters of two sockets will be connected to each other by a connecting web 56. If a cluster of eight sockets is required, these webs are left intact but if a cluster of only two sockets is needed, the webs are removed.

It will be apparent from the foregoing that contact sockets in accordance with the invention can be manufactured by relatively simple tooling, specifically, punches and dies which merely move into the metal and which are not required to form or fold the metal into a cylindrical shape. Notwithstanding the simplicity of the tooling and the manufacturing process, contact sockets in accordance with the invention have many of the advantages of contact sockets produced by screw machine operations from solid bar stock and they have the advantages of stamped and formed sockets produced by forning a cylinder from a flat blank and assembing a contact spring to the cylinder. Specifically, contact sockets in accordance with the invention have a "closed entry" which is to say they do not have an open seam as do cylindrical stamped and formed sockets of conventional design. Furthermore, the contact spring is integral with the contact socket and need not be assembled thereto in a separate assembly operation. This feature is advantageous not only for the reason that the assembly operation is avoided but also by virtue of the higher reliability achieved by providing an integral contact spring.

We claim:

1. A cluster of at least two electrically commoned contact sockets which are intended to receive contact pins, each of the sockets having a contact surface which bears against an inserted pin and having a contact spring for maintaining the contact pin against the contact surface, the cluster being characterized in that:

the cluster comprises a one piece section of conductive sheet metal having a rectangular face, the face having side edges and first and second end edges, the side edges having side flanges extending therefrom in one direction, the contact sockets comprising first and second openings in the face which are proximate to the first and second end edges respectively and between the side edges, each of the openings having a pair of diametric slots extending therefrom to the side edges and into the flanges, the slots having blind ends which are in the flanges, the slots and the openings dividing the cluster into first and second end sections and a center section, the center section being between the first and second openings and slots, the first and second end sections extending from the first and second openings and slots to the first and second end edges respectively, the face having contact flanges extending therefrom at the peripheries of the openings, the contact flanges being between the slots whereby, upon insertion of a contact pin into one of the openings, the contact flange of the opening will be against the surface of the pin, and the end section which is between the one opening and the associated end edge will be resiliently deflected and serve as a contact spring.

2. A cluster of electrically commoned contact sockets as set forth in claim 1 characterized in that the cluster comprises at least four contact sockets arranged as two associated pairs of sockets, each pair comprising a rectangular face as set forth in claim 1, the faces being in side-by-side co-planar relationship with adjacent side edges, and an integral connecting web extending between the adjacent side edges.

3. A cluster of electrically commoned contact sockets as set forth in either of claims 1 or 2 characterized in that the contact flanges are drawn flanges.

4. A cluster of electrically commoned contact sockets as set forth in either of claims 1 or 2 characterized in that the cluster is contained in an insulating housing, the housing having a housing face, the faces of the cluster being parallel to the housing face.

5. A cluster of electrically commoned contact sockets as set forth in claim 4 characterized in that each of the contact flanges of each of the openings has convergently tapered side edges.

6. A stamped and formed contact socket which is dimensioned to receive a contact pin, the socket being of the type having a contact spring for maintaining contact force on an inserted contact pin, the contact socket being characterized in that:

the contact socket comprises an opening in a flat face, the face having side edges and at least one end edge which extends transversely with respect to the side edges and which is adjacent to the opening, each of the side edges having a side flange extending therefrom perpendicularly of the face, a pair of diametric slots extend from the opening to the side edges and into the side flanges, contact flanges extend in the one direction from the periphery of the opening, the contact flanges having contact surfaces which are contacted upon insertion of the pin into the opening, the face having an end section which is between the opening and the one end edge whereby, upon insertion of a contact pin into the opening, the contact flanges of the opening will be against the contact pin, and the end section of the face and portions of the side flanges which are between the one end and the slots will be resiliently deflected and serve as a contact spring.

7. A stamped and formed contact socket as set forth in claim 6 characterized in that the contact flanges are between the slots and have side edges which taper convergently from the face.

* * * * *